US005912624A

United States Patent [19]

Howard, II

[11] Patent Number: 5,912,624

[45] Date of Patent: Jun. 15, 1999

[54] INFANT'S SLEEP TIME MONITOR

[76] Inventor: Ronald F. Howard, II, 212 Blaine St., Grove City, Pa. 16127

[21] Appl. No.: 08/891,107

[22] Filed: Jul. 10, 1997

[51] Int. Cl.[6] ..... G08B 17/10

[52] U.S. Cl. ..... 340/632; 340/573.1; 340/521; 340/628; 340/539

[58] Field of Search ..... 340/632, 573, 340/521, 628, 691, 693, 539

[56] References Cited

U.S. PATENT DOCUMENTS

| | | | |
|---|---|---|---|
| D. 350,300 | 9/1994 | Drowning et al. | D10/106 |
| 3,658,052 | 4/1972 | Alter | 340/573 |
| 3,964,036 | 6/1976 | Adachi et al. | 340/237 S |
| 4,536,274 | 8/1985 | Papadakis et al. | 204/433 |
| 4,904,988 | 2/1990 | Nesbit et al. | 340/628 |
| 5,276,434 | 1/1994 | Brooks et al. | 340/632 |
| 5,280,273 | 1/1994 | Goldstein | 340/632 |
| 5,382,943 | 1/1995 | Tanaka | 340/693 |
| 5,512,880 | 4/1996 | Abrams et al. | 340/539 |
| 5,592,147 | 1/1997 | Wong | 340/628 |
| 5,644,294 | 7/1997 | Ness | 340/521 |

*Primary Examiner*—Jeffery A. Hofsass
*Assistant Examiner*—Anh La
*Attorney, Agent, or Firm*—David L. Volk

[57] ABSTRACT

A framework is adapted to connect to a top of an infant's crib. A plurality of carbon dioxide detectors are attached to the framework. The carbon dioxide detectors are decorated for viewing pleasure of the infant. An alarm and a processor are provided. The processor is configured to energize the alarm upon decreased fluctuation of carbon dioxide levels. A smoke detector, a carbon monoxide detector and a temperature sensor are also provided. At least one microphone and a transmitter are provided to transmit an infant's sounds to a remote receiver. A control panel is provided for inputting information and status indication.

9 Claims, 4 Drawing Sheets

INFANT'S SLEEP TIME MONITOR

BACKGROUND OF THE INVENTION

1. Field of the Invention

The present invention relates to monitoring systems, particularly for carbon dioxide, smoke, carbon monoxide, temperature and sound.

2. Description of the Related Art

Sudden Infant Death Syndrome (or SIDS) is a fatal condition in which a sleeping infant stops breathing. Some children are at a greater risk from SIDS than others. Parents who are aware of greater risk factors in their children, worry each time they put their baby down to sleep.

What is needed is a device which will monitor an infant's breathing, as well as other factors which relate to SIDS. Such a device should sound an alarm when a potentially harmful or fatal condition is sensed. This alarm would not only alert the parents or caretaker of the baby, but may also help to arouse a child who has stopped breathing.

SUMMARY OF THE INVENTION

The infant's sleep time monitor of the present invention includes a framework adapted to connect to a top of an infant's crib. A plurality of carbon cioxide detectors are attached to the framework. The carbon dioxide detectors are decorated with teddy bears or other similar structure. An alarm and a processor are provided. The processor is configured to energize the alarm upon decreased fluctuation of carbon dioxide levels, which would indicate that an infant within the crib has stopped breathing.

A smoke detector, a carbon monoxide detector and a temperature sensor are also provided. Ambient temperature and passive cigarette smoke may be linked to SIDS, and inhalation of carbon monoxide can cause death. Thus, if the room temperature goes out of an acceptable range, or if cigarette smoke or carbon monoxide are detected, an alarm can be energized to indicate the situation.

At least one microphone and a transmitter are provided to transmit an infant's sounds to a remote receiver. This can be used to listen for the normal breathing sounds of the infant, or to indicate when the child has awakened.

The sound of the alarm will be such that it is likely to awaken the sleeping infant, even to arouse the infant in some instances when breathing has slowed or stopped. Of course, the alarm also serves the conventional function of alerting a parent or other caretaker of the situation.

A control panel is provided for inputting information and status indication.

Still further features and advantages will become apparent from the ensuing description and drawings.

DETAILED DESCRIPTION

Figure 1:
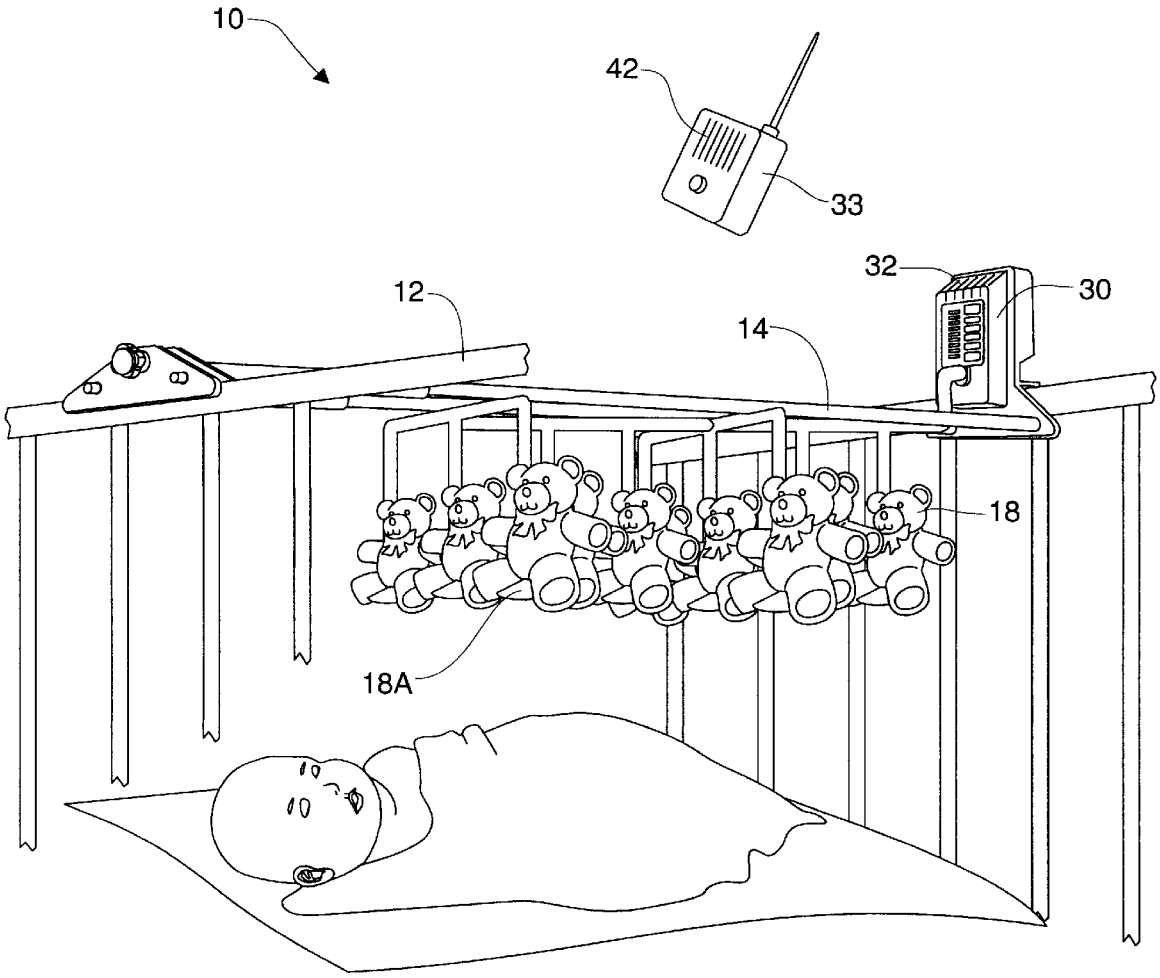
FIG. 1 is a perspective view of a monitoring system of the present invention, in use on an infant's crib.
Figure 2:
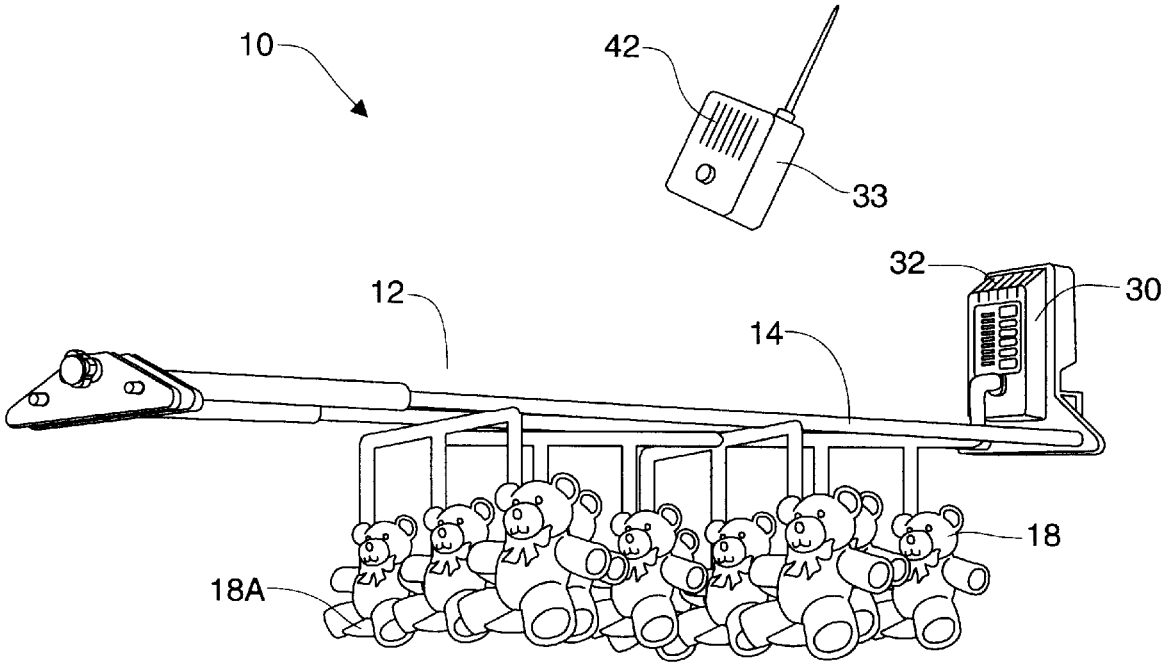
FIG. 2 is a perspective view of the monitoring system, shown without the crib.
Figure 3:
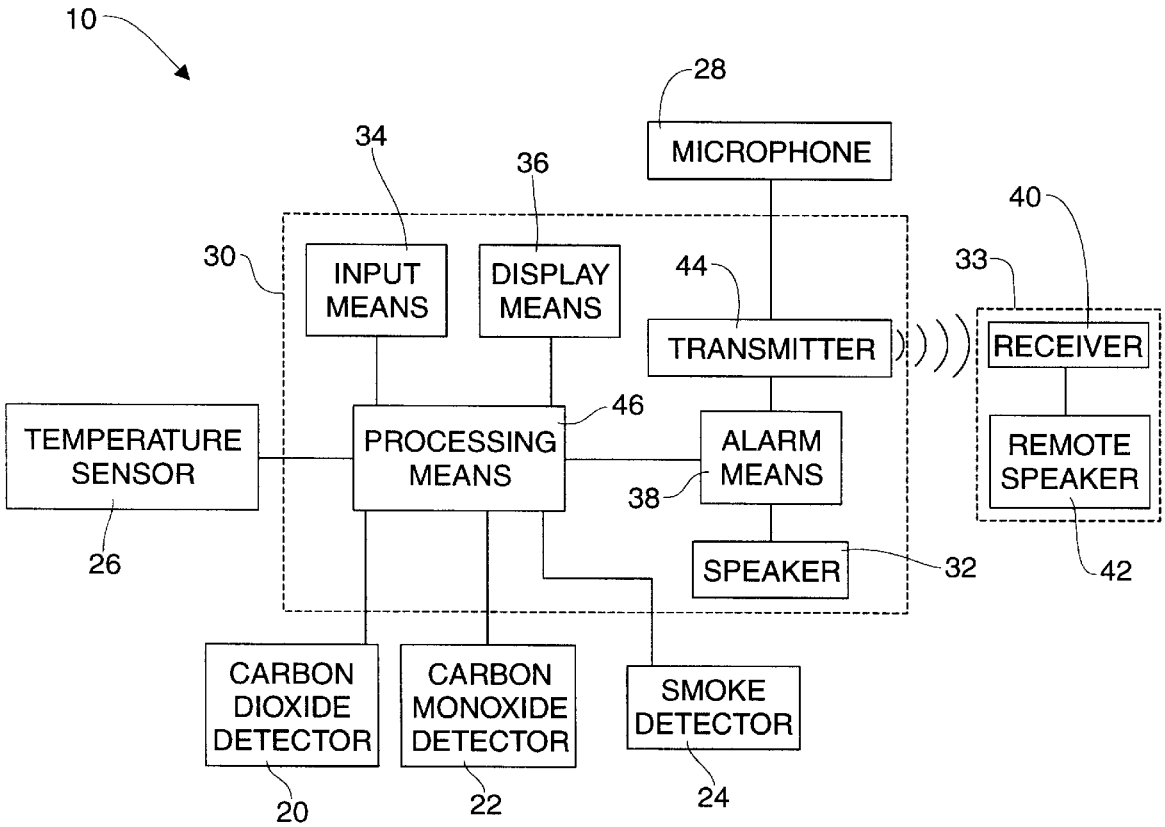
FIG. 3 is a block schematic diagram of the monitoring system.

FIG. 1 is a perspective view of a monitoring system 10 of the present invention, in use on an infant's crib 12. FIG. 2 is a perspective view of the monitoring system 10, shown without the crib. FIG. 3 is a block schematic diagram of the monitoring system 10. Referring to FIGS. 1, 2 and 3, the monitoring system 10 includes a framework 14 adapted to connect to a top of the infant's crib 12. A plurality of decorations 18 are attached to the framework 14. Each of the decorations 18, which in this figure are configured like teddy bears, includes a cone 18A having its opening pointed downward toward the crib 12.

Each of the cones 18A may contain one or more of the following within:

a. a carbon dioxide detector 20;

b. a carbon monoxide detector 22;

c. a smoke detector 24;

d. a temperature sensor 26; and e. a microphone 28.

Each of the cones 18A is adjustable in a known manner, to permit positioning of the cone 18A to a location which is most suitable for accomplishing the intended function of the device or devices within the cone 18A. The carbon dioxide detectors 20 must be positioned to measure carbon dioxide levels in the vicinity of the infant's head. The microphones 28 similarly should be positioned near the infant's head. The carbon monoxide detector 22, the smoke detector 24 and the temperature sensor 26 may be positioned away from the infant's head, since they are not measuring the infant's respiration or sounds.

A control panel 30 is provided for turning the monitoring system 10 on and off, for inputting information to the monitoring system 10 through an input means 34, and for indicating status of the monitoring system 10 through a display means 36. The control panel 30 also includes a speaker 32 for sounding an alarm generated by an alarm means 38 when a potentially harmful or fatal condition is indicated by the monitoring system 10.

A remote unit 33 comprises a receiver 40 and a remote speaker 42 for receiving signals from a transmitter 44. These signals will represent sound received through the microphones 28, or an alarm generated by the alarm means 38.

The alarm means 38 may be configured to generate different sounding alarms depending upon the condition. Some alarms may be sent to the remote unit 33 only. For example, when the temperature as sensed by the temperature sensor 26 goes slightly out of range, it is probably not necessary to arouse the infant. In this case, it is appropriate to send the alarm to the remote unit 33 only. Of course, the alarm in this case should sound different than an alarm related to the carbon dioxide levels, which would indicate that the infant has probably stopped breathing. This will help to keep the parent or caretaker from becoming unnecessarily anxious.

As shown in FIG. 3, all of the functions of the monitoring system 10 are controlled by a processing means 46. The processing means 46 includes well known electronic circuitry and microchips as needed to accomplish the necessary functions.

Figure 4:
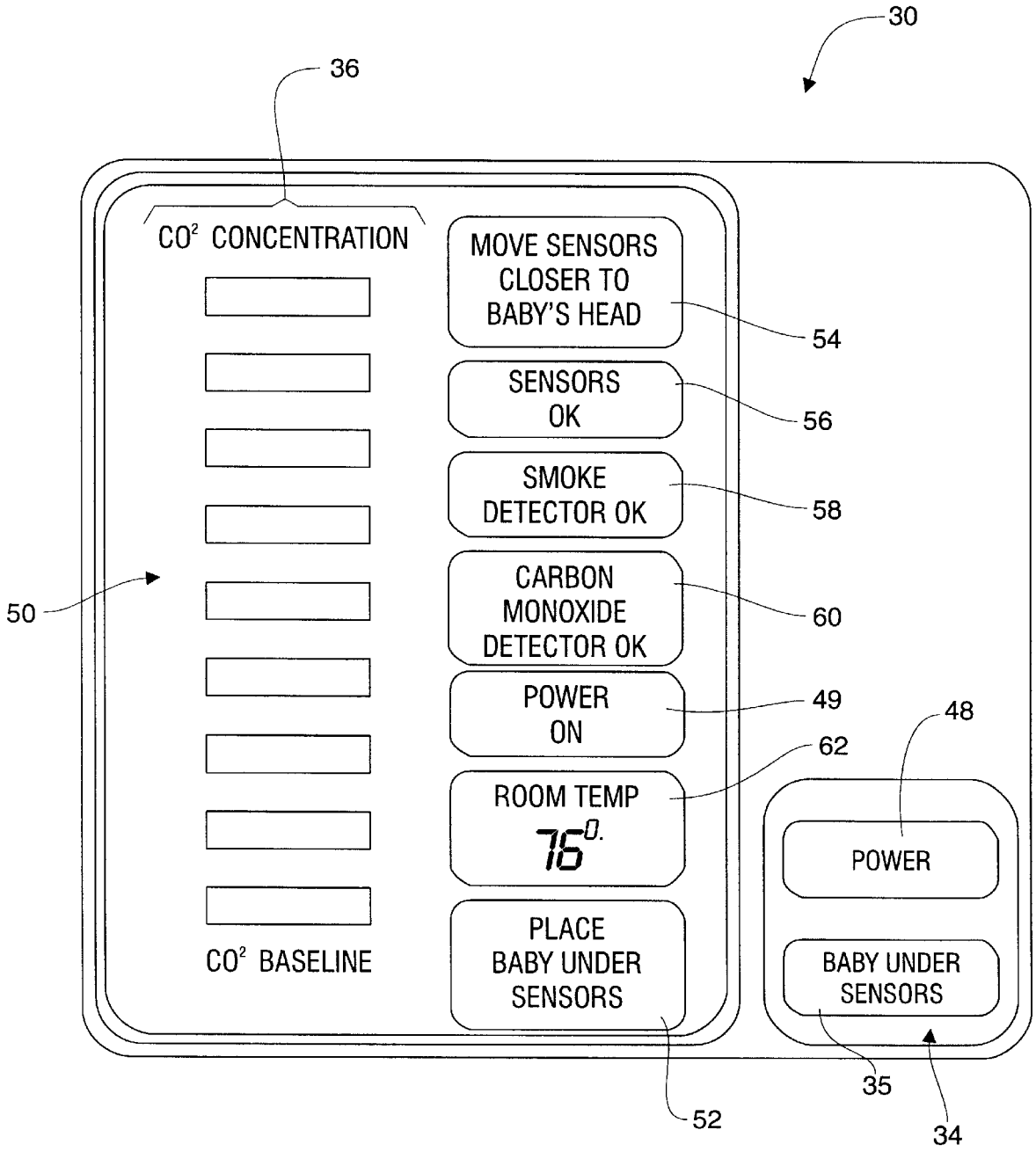
FIG. 4 is a partial front elevational view of a control panel.

FIG. 4 is a partial front elevational view of the control panel 30. Before the parent or caretaker lays the infant within the crib 12, they press the power switch 48 to energize the monitoring system 10. A "power on" indicator 49 will energize. The carbon dioxide detector 20 then senses a base line level of carbon dioxide. This is termed a "base line" level because it is the level of carbon dioxide which is read by the carbon dioxide detectors 20 when the infant is not near the carbon dioxide detectors 20.

After the base line level of carbon dioxide is detected, a "place baby under sensors" indicator 52 is energized. This is an indication to the parent or caretaker to place the infant in the crib 12 beneath the carbon dioxide detectors 20. After placing the infant beneath the carbon dioxide detectors 20, the parent or caretaker presses a "baby under sensors" key 35.

Placing the infant under the carbon dioxide detectors 20 should cause a repetitive fluctuation in the carbon dioxide level due to the respiration of the infant. If this fluctuation is not detected after the "baby under sensors" key 35 has been pressed, a "move sensors closer to baby's head" indicator 54 is energized. When the fluctuating level is finally detected, the "sensors OK" indicator 56 is energized.

The fluctuating level of carbon dioxide is indicated on the carbon dioxide level indicator 50, which comprises a series of lights. Only a single light at the bottom will be lit when the base line level is being detected. As the carbon dioxide level increases, the lights will energize in sequence toward the top of the indicator 50. As the carbon dioxide level falls, the lights will deenergize in sequence toward the bottom of the indicator 50.

A "smoke detector OK" indicator 58 will energize to indicate that the smoke detector 24 is working, and no smoke is being detected.

A "carbon monoxide detector OK" indicator 60 will energize to indicate that the carbon monoxide detector 20 is working, and no carbon monoxide is being detected.

The temperature as indicated by the temperature sensor 26 is displayed on a room temperature display 62.

The foregoing description is included to describe embodiments of the present invention which include the preferred embodiment, and is not meant to limit the scope of the invention. For example, various inputs, displays, functions and detectors may be added or subtracted from the present invention with departing from the spirit thereof.

From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A monitoring and alarm system comprising:

a. at least one carbon dioxide detector;

b. a processing means;

c. an alarm means; and d. the processing means configured to energize the alarm means upon decreased undulation of carbon dioxide levels as sensed by the at least one carbon dioxide detector.

2. The monitoring and alarm system of claim 1, further comprising at least one smoke detector, and wherein the processing means is configured to energize the alarm means upon detection of smoke.

3. The monitoring and alarm system of claim 1, further comprising at least one carbon monoxide detector, and wherein the processing means is configured to energize the alarm means upon detection of carbon monoxide.

4. The monitoring and alarm system of claim 1, further comprising at least one microphone, a transmitter, and a remote receiver configured to monitor sounds transmitted through the microphone.

5. The monitoring and alarm system of claim 1, further comprising a temperature sensor and a display means, and wherein the display means is configured to display measured temperature.

6. The monitoring and alarm system of claim 1, further comprising a control panel, and wherein the monitoring and alarm system is adapted for attachment to an infant's crib.

7. The monitoring and alarm system of claim 6, wherein the at least one carbon dioxide detector is positionally adjustable to permit placement of the at least one carbon dioxide detector in a location which is optimum for detection of carbon dioxide levels associated with respiration from a sleeping infant in the crib.

8. The monitoring and alarm system of claim 7, wherein the control panel comprises:

a. an "on-off" switch means;

b. a "sensors okay" indicator;

c. a "place baby under sensors" indicator; and d. the processing means configured to implement the following steps:

i. when the "on-off" switch means is positioned in an "on" position, the carbon dioxide detector senses a base line level of carbon dioxide;

ii. after the base line level of carbon dioxide is sensed, the "place baby under sensors" indicator is energized; and iii. the "sensors okay" indicator is energized after a fluctuating level of carbon dioxide is sensed.

9. A monitoring and alarm system comprising:

a. a framework adapted to connect to a top of an infant's crib;

b. a plurality of carbon dioxide detectors attached to the framework;

c. at least some of the carbon dioxide detector:s being positionally adjustable to permit placement of the carbon dioxide detector in a location which is optimum for detection of carbon dioxide levels associated with respiration from a sleeping infant in the crib;

d. each of the carbon dioxide detectors being decorated for viewing pleasure of the infant;

e. an alarm means;

f. a processing means configured to energize the alarm means upon decreased fluctuation of carbon dioxide levels;

g. at least one smoke detector, the processing means being configured to energize the alarm means upon detection of smoke;

h. at least one carbon monoxide detector, the processing means being configured to energize the alarm means upon detection of carbon dioxide;

i. at least one microphone, a transmitter, and a remote receiver configured to monitor sounds transmitted through the microphone;

j. a temperature sensor and a display means, the display means configured to display measured temperature;

k. a control panel comprising:

i. an "on-off" switch means;

ii. a "sensors okay" indicator;

iii. a "place baby under sensors" indicator;

l. the processing means configured to implement the following steps:

i. when the "on-off" switch means is positioned in an "on" position, the carbon dioxide detector senses a base line level of carbon dioxide;

ii. after the base line level of carbon dioxide is sensed, the "place baby under sensors" indicator is energized; and iii. the "sensors okay" indicator is energized after a fluctuating level of carbon dioxide is sensed.

* * * * *